US005487295A

United States Patent [19]

Diekhoff et al.

[11] Patent Number: 5,487,295

[45] **Date of Patent: * Jan. 30, 1996**

[54] METHOD OF FORMING A METAL CONTAINER BODY

[75] Inventors: Hans H. Diekhoff, Avonmore; George L. Smith, Jr., New Kensington, both of Pa.

[73] Assignee: Aluminum Company of America, Pittsburgh, Pa.

[ * ] Notice: The portion of the term of this patent subsequent to Aug. 18, 2013, has been disclaimed.

[21] Appl. No.: 397,815

[22] Filed: Mar. 3, 1995

Related U.S. Application Data

[63] Continuation of Ser. No. 108,898, Aug. 18, 1993, Pat. No. 5,394,727.

[51] Int. Cl.[6] ..... B21D 22/28

[52] U.S. Cl. ..... 72/379.4

[58] Field of Search ..... 72/348, 379.4, 72/347, 349

[56] References Cited

U.S. PATENT DOCUMENTS

| | | | |
|---|---|---|---|
| 3,760,751 | 9/1973 | Dunn et al. . | |
| 3,855,862 | 12/1974 | Moller . | |
| 3,905,507 | 9/1975 | Lyu . | |
| 3,972,217 | 8/1976 | Misonoo . | |
| 3,998,174 | 12/1976 | Saunders . | |
| 4,099,475 | 7/1978 | Lee, Jr. . | |
| 4,151,927 | 5/1979 | Cvacho et al. . | |
| 4,177,746 | 12/1979 | Lee, Jr. et al. . | |
| 4,294,373 | 10/1981 | Miller et al. . | |
| 4,372,143 | 2/1983 | Elert et al. . | |
| 4,685,322 | 8/1987 | Clowes . | |
| 4,723,433 | 2/1988 | Grims . | |
| 5,394,727 | 3/1995 | Diekhoff et al. | 72/348 |

*Primary Examiner*—Lowell A. Larson
*Attorney, Agent, or Firm*—David W. Brownlee

[57] ABSTRACT

A method of forming a drawn metal cup for a container body which includes drawing a cup having a circular boss in its base wall, redrawing the cup and forming a pressure resistant profile in its base wall.

7 Claims, 4 Drawing Sheets

METHOD OF FORMING A METAL CONTAINER BODY

This application is a continuation of application Ser. No. 08/108,898 filed Aug. 18, 1993 now U.S. Pat. No. 5,394, 727.

BACKGROUND OF THE INVENTION

This invention relates to a method of forming a container body such as a drawn container body formed from a metal blank, and to a container body formed by such method. More particularly, it relates to a method which minimizes or avoids wrinkling of metal during forming of the bottom profile in a container body.

It is well known to draw and iron a sheet metal blank to make a thin-walled can body for packaging carbonated beverages. It is also well known that metal manufacturers, can makers and carbonated beverage packagers have had, and continue to have, a goal to reduce the weight of containers and thereby reduce the cost of packaging. One way to reduce weight of can bodies and cans is to form a bottom profile which is capable of strengthening the base wall's resistance against buckling from internal pressure. By so doing, thinner metal can be used to make the can and thereby reduce weight and cost. U.S. Pat. Nos. 3,905,507; 4,099,475; 4,151,927; 4,177,746; 4,294,373 and 5,105,953 are a few of the many which are concerned with bottom profiles and methods of making such profiles.

Many base wall profiles for beverage cans include an annular portion which slopes generally inwardly and downwardly from a bottom portion of the can sidewall and an inwardly projecting dome portion circumscribed by such annular portion. The thinner the metal from which containers are made, the greater the tendency for the metal in the inwardly and downwardly projecting annular wall to wrinkle during redrawing and doming. Clowes U.S. Pat. No. 4,685, 322 discloses a method for reducing wrinkling by forming an inwardly (upwardly) projecting annular bead in the bottom wall of the cup which is subsequently redrawn into a container. Elert et al., U.S. Pat. No. 4,372,143 proposes another solution which involves adapting the apparatus used to form the dome so as to support the beveled annular wall with a pressure ring while the dome is being formed.

Another way to reduce can weight is by using smaller diameter lids to close the can bodies. This alternative requires that the center dome on the base profile of the can body also have a smaller transverse diameter in order to facilitate stacking of cans on one another, especially filled cans with small diameter lids on them.

An improved method of forming is needed which minimizes or avoids wrinkling in the bottom profile of redrawn cans, especially for cans made of thin metal and having bottom domes with small transverse diameters.

SUMMARY OF THE INVENTION

The present invention is a method for drawing and redrawing a metal blank to form a can body having a base profile which includes a frusto-conical annular wall portion extending generally inwardly and downwardly from the generally cylindrical can body sidewall and an inwardly projecting dome portion circumscribed by such annular wall portion. The method may include ironing the sidewall of the can body. This invention draws a metal blank into a cup having a round boss or annular protrusion projecting into or from its base wall. The boss has an annular wall that is located in a portion of the base wall which will be formed into the frusto-conical wall of the bottom profile when the cup is redrawn.

It is an objective of this invention to provide a method which minimizes wrinkling in the base profile of a can body during redrawing.

Another objective of this invention is to provide a base profile for can bodies which permits stacking of filled cans, with small diameter lids, on one another.

It is an advantage of this invention that thinner metal can be used to make a can body. A further advantage of this invention is that a dome with a smaller transverse diameter can be formed in the bottom profile of a can body while retaining pressure holding capabilities.

These and other objectives and advantages of this invention will be more fully understood and appreciated with reference to the following description and associated drawings.

DESCRIPTION OF A PREFERRED EMBODIMENT

Figure 1A:
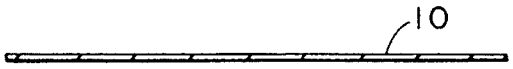
FIG. 1A–1E is a cross-sectional view showing the progression for forming a drawn and ironed can body from sheet aluminum in accordance with this invention.
Figure 1B:
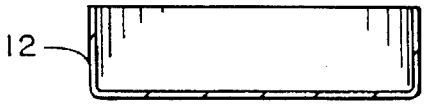
Figure 1C:
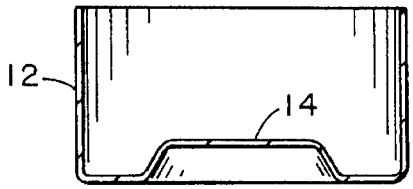
Figure 1D:
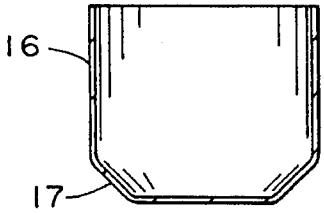
Figure 1E:
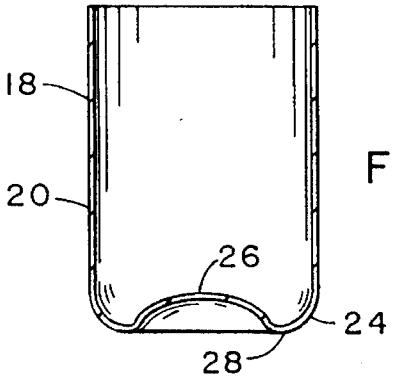

For ease of description and illustration, the invention will be described with respect to making a drawn and ironed beverage can body, but it is understood that its application is not limited to such a can body. It can also be applied to a method of making a drawn cup or container body which is not ironed, such as a food can body. The directions "upward" or "upwardly", and "downward" or "downwardly" are used for convenience to describe a cup or can body in an upright position with the open end facing upward. Those skilled in the art will appreciate that such cups and can bodies may have other orientations in the practice of their manufacture. The terms "inwardly" and "outwardly" are used to mean the directions toward or away from the interior of a cup or can body or toward or away from the longitudinal axis of a cup or can body.

In a typical manufacturing method of making a drawn and ironed can body, a circular disc or blank is cut or blanked from a sheet of light gauge metal, such as 3004-H19 aluminum alloy, and the blank is drawn into a cup. The cup is then transferred to a body maker comprised of a punch adapted to move longitudinally and force the cup through a redraw die and then through coaxially aligned ironing rings. As the redrawn cup is forced through the ironing rings, the sidewall is thinned. At the end of the punch travel, a bottom forming die cooperates with the punch to produce a profile in the base wall of the can body. This forming of the base profile is typically referred to as "doming ".

By practicing a method of this invention, thinner gauge metal such as 0.009 to 0.010 inch thick, rather than 0.0116 inch thick, aluminum alloy can be formed into a can body which results in metal savings in at least the end wall portion of the can body. This invention also makes it possible to form thin gauge metal can bodies having bottom domes with smaller transverse diameters with little or no wrinkling. This facilitates additional metal savings by enabling stacking of filled cans with smaller diameter lids on them.

The aluminum alloy which is used in the practice of this method can be of the 3000 series alloy, such as 3004-H19, or other aluminum alloys having high strength and formability. The method of this invention can also be applied to forming of can bodies from sheets of steel or other metals.

FIG. 1 shows the progression of forming a can body in accordance with this invention. A disc or blank 10 is first cut from a sheet of aluminum alloy, the disc 10 is reformed into a cup 12, an annular protrusion or recessed boss 14 is formed in the base wall of the cup, the cup 12 is redrawn into a redrawn cup 16, and the redrawn cup is ironed and reformed into can body 18. The can body 18 of FIG. 1 has a drawn and ironed sidewall 20 and a base wall with a pressure-resistant profile. The base profile includes an outer frusto-conical wall portion 24 extending generally inwardly and downwardly from the sidewall 20, an inwardly projecting dome portion 26, and an arcuate portion 28 connecting the frusto-conical wall portion 24 and the dome portion 26.

Figure 2:
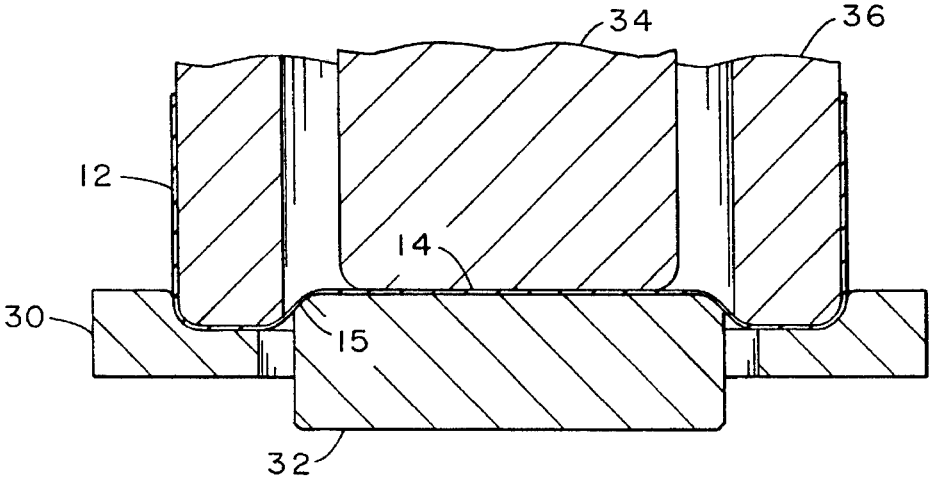
FIG. 2 is a cross-sectional view of apparatus for forming a drawn cup having an inwardly projecting circular boss in its base wall in accordance with this invention.
Figure 3:
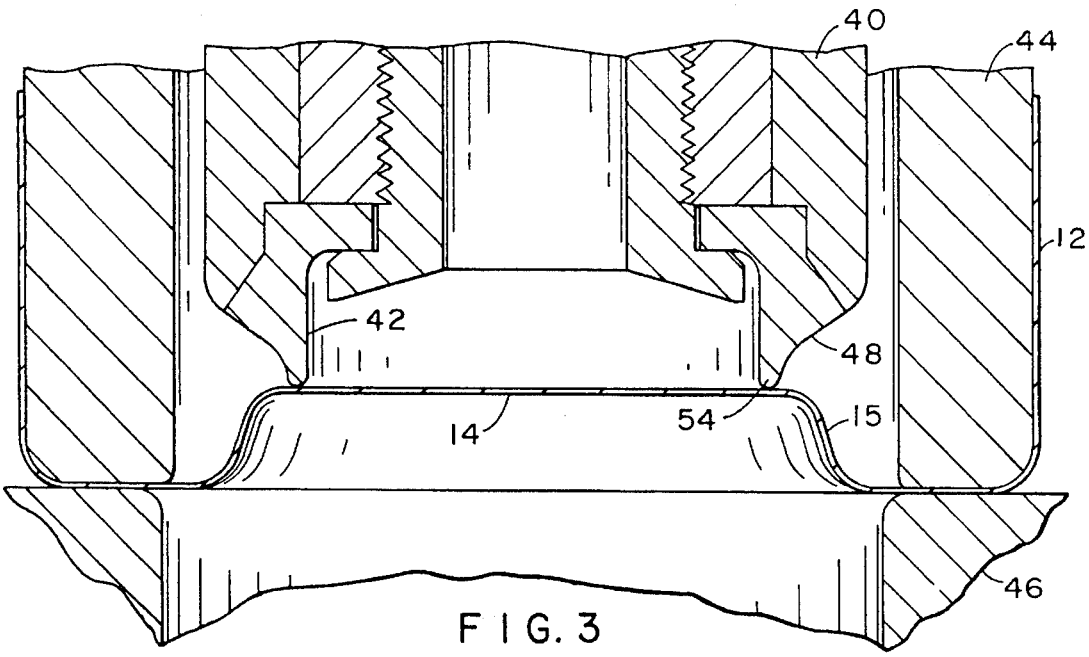
FIG. 3 is a cross-sectional view of apparatus for redrawing and reforming the cup shown in FIG. 2.

The first step of cutting a blank or disc 10 and drawing the disc into a cup 12 is well known in the art and not shown here. After the cup 12 has been formed by any suitable drawing method, the base wall of the cup is reformed as shown in FIG. 2 to form an inwardly projecting boss 14 therein. As used herein, "boss" means a circular protrusion in the bottom end of the cup. The boss 14 preferably projects into the cup 12 as shown in FIG. 1, but can also project downwardly from the cup. The boss 14 has an annular wall 15 which is generally located in the portion of the base wall of the cup 12 which will be formed into the inwardly and downwardly extending frusto-conical wall 17 of the redrawn cup 16 and frusto-conical wall 24 of can body 18. As another point of reference, the preferred position for locating the annular wall 15, is adjacent to and outward of the nose of the punch which is used to redraw, iron and form the base profile as is explained below with reference to FIGS. 3–8. The annular wall 15 may have a variety of shapes such as curvilinear, as shown in FIGS. 2 and 3, or substantially frustoconical depending on tool configuration among other things. The location of wall 15, and not its shape, is important in the practice of the invention.

FIG. 2 shows apparatus for forming a recessed boss 14 in the base wall of cup 12. The apparatus includes a locating pressure ring 30 which is preferably resiliently mounted in a press as with springs or pressure means, a die block 32, knockout 34 and a movable forming sleeve 36. The sleeve 36 draws the cup 12 over the die block 32 and against the pressure ring 30 to form the boss 14 in the cup. The knockout 34 strips the cup 12 from the sleeve 36 when the sleeve is moved upwardly upon completion of the forming operation. Alternatively the knockout 34 could be replaced with a stripper ring, not shown, that would be disposed around the forming sleeve 36. Although FIGS. 1 and 2 show the boss 14 being formed in a cup 12 that has been drawn in a prior operation in different dies, the preferred method is to form the boss in the same press and dies which are used to draw the cup, and thereby eliminate a separate forming step.

After the drawn cup 12 with boss 14 in its base wall has been formed, the cup is transferred to a bodymaker in which the cup is redrawn, its sidewall ironed and its base wall reformed. FIGS. 3–8 illustrate such progressive operations. The body maker has a reciprocating ram with an ironing punch sleeve 40, an ironing punch nose 42 and redraw sleeve 44 mounted on it. The ram moves the ironing punch sleeve 40, nose 42 and redraw sleeve 44 into the cup 12 and carries the cup with the ironing punch and redraw sleeve until the cup and redraw sleeve abut against the redraw die 46. The ironing punch sleeve 40 and nose 42 then move the cup 12 through the redraw die 46 and then through a series of conventional ironing rings, not shown. The punch nose 42 has a recessed center or hollow end to permit forming of the dome in the end of the can body at completion of the ram stroke (FIG. 8). The punch nose 42 also has a generally frustoconical outer peripheral surface 48 on its axially projecting nose portion 54 for forming a frusto-conical wall portion on the redrawn cup (FIG. 6) and can body (FIG. 8). Surface 48 is preferably slightly concave to mate with a convex surface of the doming tools as shown in FIG. 8 and to produce a preferred concavo-convex annular wall 24 on the container body.

It is important to this invention that cup 12 be dimensioned so that the annular wall 15 of the boss 14 on the cup be disposed substantially in line axially (of the cup body and punch sleeve 40) with the frusto-conical surface 48 on the punch. This is important because wall 15 provides the metal which is reformed into the frusto-conical wall 17 on the redrawn cup 16 and then into wall 24 on the can body as is described below.

Figure 4:
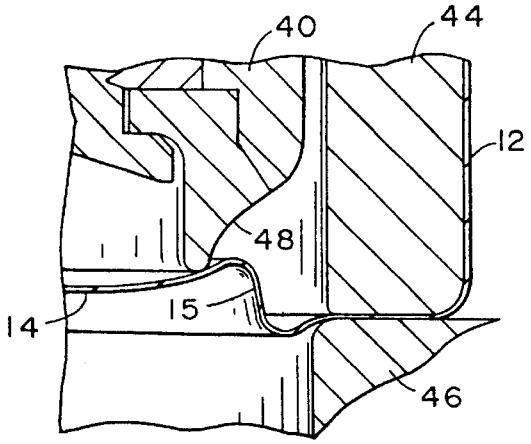
FIGS. 4–6 are partial cross-sectional views similar to FIG. 3 showing the cup in intermediate stages of being redrawn and reformed.
Figure 5:
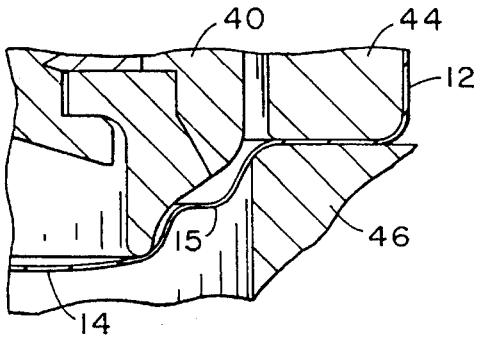
Figure 6:
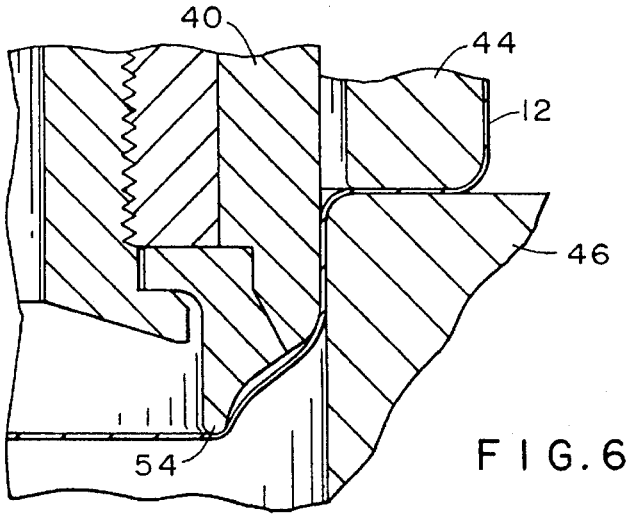

Reforming of annular wall 15 is illustrated in FIGS. 4–6. In such reforming, the metal in wall 15 rolls upwardly toward surface 48 on the punch nose 42, in an unrestricted open gap between the punch surface 48 and the redraw sleeve 44, until the metal generally conforms to such surface 48 as is best seen in FIG. 6. During such rolling, the metal in wall 15 acts as a quasi tool to control flow of adjacent metal and minimize wrinkling of the metal. The distance between the annular wall 15 and the axial centerline of cup 12 does not change, or changes very little during such rolling. Instead the metal is reformed at approximately the same radius measured from the centerline of the punch sleeve 40. This minimizes wrinkling of the metal during such reforming. Wrinkling can occur in prior art methods when metal in a cup is forced to move or is drawn toward the longitudinal axis of the cup, which means that the metal is being forced into a smaller circumference. And, forcing sheet metal into a smaller circumference is one cause of wrinkling.

Rolling of the metal in wall 15 upwardly as described above may also result in some beneficial thickening of the metal as it is compressed in column loading during such reforming. Such thickening of the metal may increase pressure resistance of the can body.

After the cup 12 has been redrawn as shown in FIGS. 3–6, the ironing punch continues its travel to move the redrawn cup 18 through a plurality of conventional ironing rings, not shown. Typically, a body maker includes two or more ironing rings coaxially aligned with the redraw ring 46, with each ironing ring having a slightly smaller diameter than the preceding ring in order to progressively thin and lengthen the sidewall of the cup.

Figure 7:
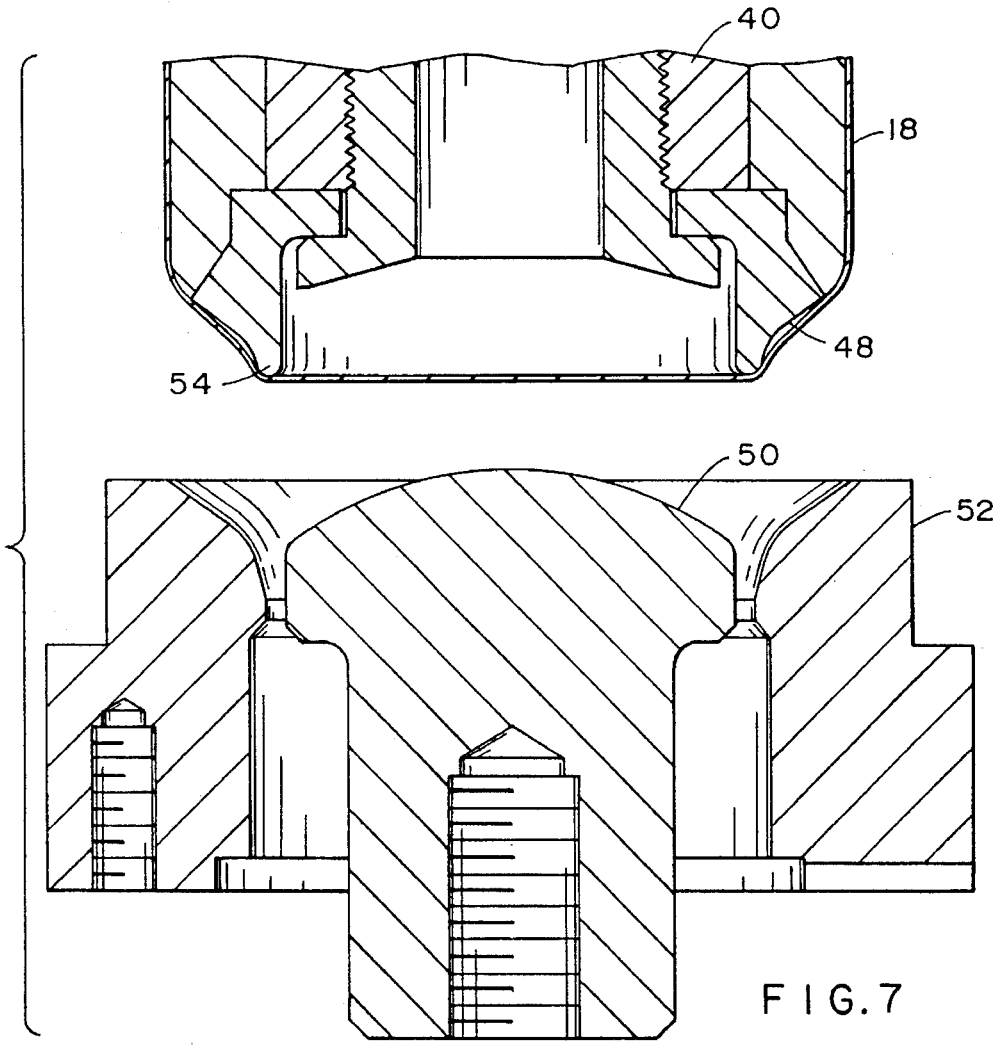
FIG. 7 is a cross-sectional view of the punch shown in FIGS. 3–6 in combination with a typical doming tool for forming the bottom profile on a drawn and ironed can body.
Figure 8:
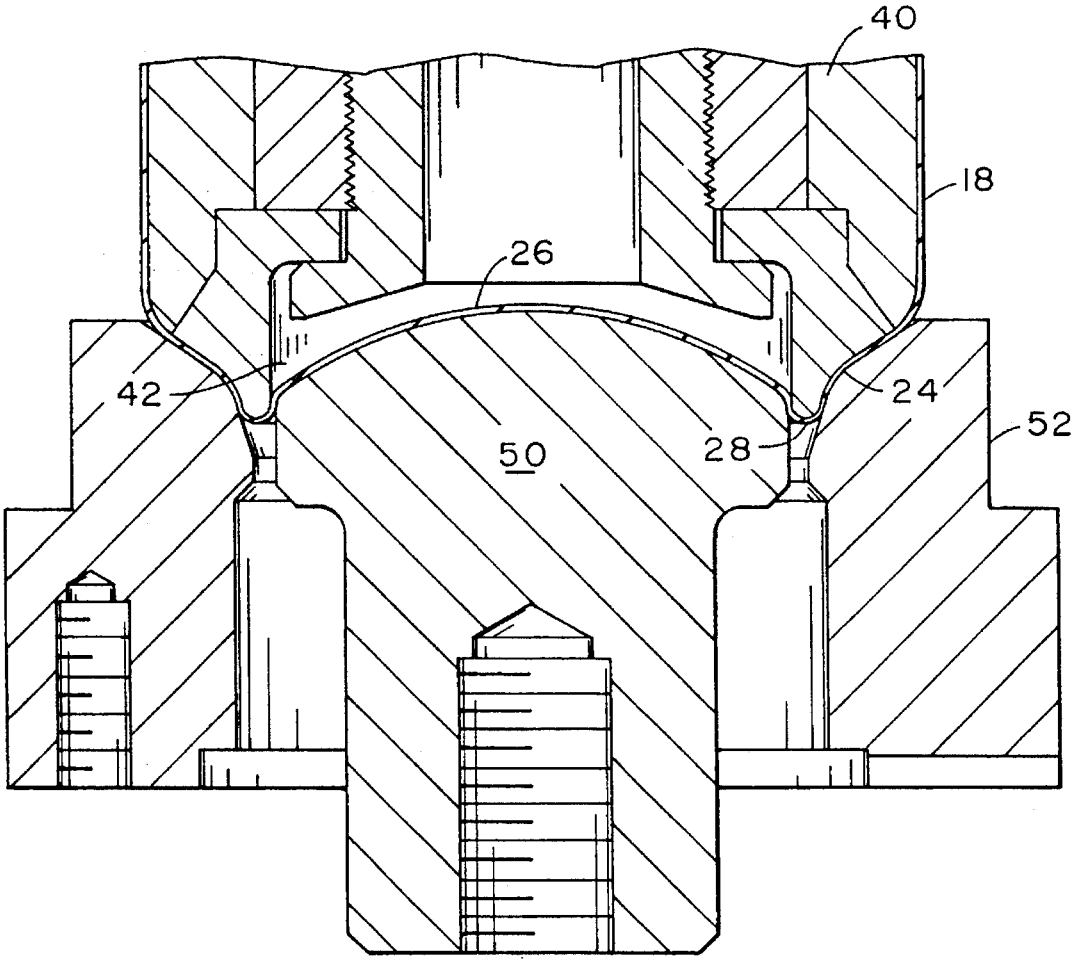
FIG. 8 is a cross-sectional view similar to FIG. 7 showing completion of forming of the end profile on the can body.

FIGS. 7 and 8 show how the inwardly projecting dome of the can body 18 is formed by pressing the base wall of the drawn and ironed body against doming tools after the body has passed through the last ironing ring. The doming tools, which are typical of tools used in the art, include a doming die 50 for forming the base wall of the can body into an upwardly projecting dome 26, and a draw die 52 for forming the frustoconical wall 24 of the can body 18 against surface 48 on punch nose 42. FIG. 8 shows the punch as it bottoms out against the doming tools at completion of the forming of the base profile on the can body 18.

It will be appreciated by those skilled in the art that the substantially frustoconical wall portion 24 of the can body have a variety of sizes and shapes. For example, such wall portion could be outwardly convex, straight, outwardly concave or a combination of curves and/or straight portions. It will also be appreciated that the dome portion 26 can have a variety of shapes and sizes as are well known in the art.

It is believed that the reduction or elimination of wrinkling in the frusto-conical wall 24 by the practice of this invention also reduces undesirable thinning of metal that can occur during doming. Forming of the inwardly projecting dome in the base profile requires some drawing of metal inwardly over the projecting nose 54 of the ironing punch and into the dome. Wrinkles in the frusto-conical wall 24 produce resistance to such drawing because the wrinkles make it more difficult to draw the metal inwardly into the dome. This resistance can cause localized elongation and thinning of the metal in the arcuate portion 28 of the base profile. Reducing wrinkling by the practice of this invention minimizes resistance to drawing of metal into the dome and thereby reduces undesirable thinning of the metal in the arcuate portion 28.

After the base profile is formed, the ironing punch is retracted or moved away from the doming tools and the can body is stripped from the punch. Such stripping is by means, not shown, such as compressed air and/or mechanical strippers which are well known in the art.

It is seen from the above that the method of this invention strategically places metal in the annular wall of the base in the drawn cup for the metal to be reformed into the frusto-conical wall in the base wall of a container body with little or no wrinkling of the metal. The specially designed shapes prevent wrinkling due to the stiffening effect they create and thus control the metal flow during the initial redraw until the lower body radius and redraw radius are approximately tangent. Then the tool profiles, gap and redraw sleeve pressure combine to provide the necessary control to complete the redraw operation. The metal in the annular wall of the boss is reformed into the frusto-conical wall of the redrawn cup without significantly displacing the metal relative to the longitudinal axis of the cup so as to minimize any confining of the metal into a smaller circumference that would cause it to wrinkle.

Forming by the method of this invention makes it possible to use 0.008 to 0.012 inch thick 3004-H19 aluminum in making a 211 diameter can body with little or no wrinkling of the profiled portions of the end wall and with no reduction in pressure holding capability. Substantially wrinkle free 211 diameter can bodies have been successfully formed with this invention with 0.010 inch gauge 3004 H19 to a 1.850 inch base diameter. As used in the art, base diameter means the diameter of a can body at the bottom of annular supporting portion 28 (FIG. 1). Prior attempts in the can making industry to consistently produce 211 diameter can bodies from less than 0.011 inch thick 3004-H19 blanks, at similar base diameters without wrinkles in the end wall, have been unsuccessful.

While the invention has been developed and is particularly useful in the manufacture of 211 diameter can bodies with a bottom profile having a 1.850 inch base diameter, the invention is also useful in the forming of larger or smaller diameter can bodies with proportionately larger or smaller base diameters on their bottom profiles.

It is believed that the reduction or elimination of wrinkling in the frusto-conical wall 24 by the practice of this invention also reduced thinning of metal that can occur during doming. Forming of the inwardly projecting dome in the base profile requires some drawing of metal inwardly over the projecting nose 54 of the ironing punch to form the dome. Wrinkles in the frusto-conical wall 24 produce resistance to such drawing, i.e., make it more difficult to draw the metal inwardly, and can cause greater localized elongation and thinning of the metal in the dome portion 26. Thus, reducing wrinkling also reduces undesirable thinning of the metal, or makes more uniform any thinning that does occur.

While the invention has been described in terms of preferred embodiments, the claims appended hereto are intended to encompass all embodiments which fall within the spirit of the invention. For example, the method of this invention can include partially forming the upwardly projecting dome in the bottom wall of the redrawn container prior to ironing of the side wall of the can body.

What is claimed is:

1. A method of forming a metal container body which comprises;

providing a metal cup having a sidewall and a base wall which includes a central transverse wall portion; a generally cylindrical annular wall portion around said central wall portion and connected to an outer peripheral wall portion which is offset with respect to said transverse wall portion; and reducing the diameter of said cylindrical annular wall of said metal cup and reforming said annular wall portion into a generally frusto conical wall portion between said central wall portion and the sidewall of the cup.

2. A method as set forth in claim 1 in which said central wall portion is reformed into an upwardly projecting dome portion subsequent to said reducing the diameter of the cylindrical annular wall of said cup.

3. A method as set forth in claim 1 in which the sidewall of said cup is ironed.

4. A method of forming as claimed in claim 1 in which said cup is drawn from an aluminum alloy sheet material having a thickness of about 0.012 inch or less.

5. A method of forming a metal can body, comprising:

drawing a cup having a sidewall and an base wall;

forming a circular boss centrally in said base wall with said boss having a transverse wall offset with respect to said base wall therearound and an annular wall connecting said transverse wall and said base wall adjacent the sidewall of the cup;

redrawing said cup to reduce its diameter; and reforming said annular wall into a generally frustoconical wall portion extending downwardly and inwardly from the sidewall to said base wall.

6. A method as set forth in claim 5 which includes ironing said sidewall to reduce its thickness and forming an upwardly projecting dome in said base wall.

7. A method of forming as claimed in claim 6 which said redrawing, ironing and reforming are performed in a single stroke of a punch.

* * * * *